US005682930A

United States Patent [19]

Crossdale

[11] Patent Number: 5,682,930

[45] Date of Patent: Nov. 4, 1997

[54] AUTOMATED DISPENSER

[75] Inventor: Garry W. Crossdale, Ripley, United Kingdom

[73] Assignee: Diversey Corporation, Mississauga, Canada

[21] Appl. No.: 632,492

[22] PCT Filed: Oct. 31, 1994

[86] PCT No.: PCT/CA94/00600

§ 371 Date: Jun. 26, 1996

§ 102(e) Date: Jun. 26, 1996

[87] PCT Pub. No.: WO95/12544

PCT Pub. Date: May 11, 1995

[30] Foreign Application Priority Data

Nov. 3, 1993 [GB] United Kingdom ..... 9322641

[51] Int. Cl.[6] ..... B65B 1/04

[52] U.S. Cl. ..... 141/104; 141/87; 141/94; 141/367

[58] Field of Search ..... 141/9, 18, 87, 141/88, 94, 104, 351, 360–362, 367, 378; 200/46; 285/913, 914, 24, 27

[56] References Cited

U.S. PATENT DOCUMENTS 4,386,640 6/1983 Carr et al. ..... 141/361

4,977,935 12/1990 Durkee, Jr. et al. ..... 141/99

5,083,591 1/1992 Edwards et al. ..... 141/9

5,597,019 1/1997 Thomas et al. ..... 141/18

FOREIGN PATENT DOCUMENTS

564303A1 2/1993 European Pat. Off. .

9309192 U 10/1993 Germany .

*Primary Examiner*—Henry J. Recla

*Assistant Examiner*—Steven O. Douglas

*Attorney, Agent, or Firm*—Wood, Herron & Evans, L.L.P.

[57] ABSTRACT

A dispenser for filling with liquid a container of a predetermined profile comprising a support for the container to be filled, a plurality of sources of different liquids, valves for regulating the flow of liquid from the sources into the container, a series of keys on the support, each key being movable between at least two positions, switches actuated by the respective keys, and a control connected between the switches and the valves. On mounting of a particular container on the support, the keys are moved a predetermined way by the container's predetermined profile and the control in response to the keys being moved fills the correct liquid into the container.

14 Claims, 5 Drawing Sheets

AUTOMATED DISPENSER

FIELD OF THE INVENTION

The invention relates to a dispenser for dispensing automatically selected detergents and other cleaning liquids into designated containers.

BACKGROUND OF THE INVENTION

In many industrial and semi-industrial situations, for example in large kitchens or in hotels, it is necessary to regularly fill small containers with cleaning and sanitizing liquids from bulk containers of such liquids. Typically this is done by filling the small container from a manually operated tap connected to the corresponding bulk container of desired liquid.

It is commonplace for supplies of different liquids to be provided at the same place. Where this happens, there is an obvious risk that the wrong liquid might be filled into the wrong container as labeled for a different liquid. Attempts have been made to overcome this problem in manual filling systems by color coding the sources of liquid and the containers but this does not entirely eliminate the possibility of human error.

Attempts have also been made to overcome this problem by use of electronic automated filling systems. These systems tend to be very complex, such as described in U.S. Pat. No. 5,083,591 where a paint can has attached to it a bar code label which represents a relocatable memory address of the controller computer which stores the color formula to be dispensed into the paint can and other information. Hence the bar code on the paint can can be read at a plurality of scanning stations to determine its route through the automated paint hatching system for producing paint cans of any size and color. The paint cans are not reused, hence subsequent destruction of the bar code label is irrelevant.

U.S. Pat. No. 4,977,935 describes an interlock system which is used in dispensing various types of stored polymeric resins to a plastic extruder. Hoses from the various storage bins for polymeric resin have connected thereto a removable key loosely attached to the hose by a tether. The key is inserted in a control box to signify thereby the resin available from the corresponding hose. If there is a match within the computer control system with what is identified by insertion of the key in the control box, plastic resin material can be delivered through the flexible hose. The problem, however, in tethering a key to a supply hose is that the tether can be broken with the consequent accidental replacement of the wrong key on that particular hose.

In order to prevent the dispensing of the wrong liquid into the wrong container, applicant has provided a dispensing system for filling a container with the correct liquid in accordance with the system described in its co-pending published European application EP-A-0 564 303. That system only has the capability of filling a container with a specific liquid which corresponds with a predetermined contents profile of the container.

The present invention, in its different aspects, is aimed at overcoming or ameliorating the above-described problems.

SUMMARY OF THE INVENTION

In accordance with an aspect of the invention, a dispenser for dispensing a liquid into a container of a predetermined profile comprises:

a support for the container;

a plurality of sources of different liquids;

valve means regulating the flow of liquid from the sources into the container;

a series of keys on the support, each key being moveable between at least two positions;

switch means actuated by the respective keys; and control means connected between the switch means and the valve means, whereby on mounting a particular container on the support, the keys are moved in a predetermined way by a container profile and the control means in response to at least one key being moved, actuates the valve means to dispense liquid from said plurality of sources into the container.

The keys can be in a horizontal row and move in a substantially horizontal plane. The container can be formed with a number of recesses so that, upon being slid into the support, some keys are not moved at all, because such recesses are aligned with those keys.

The support can be a platform on top of which the container sits, but it is preferably a cradle which holds the container by its upper portion—for example its neck—with the major part of the container depending from the cradle. This latter arrangement has the advantage that different size bottles can be filled from the same dispenser without major adjustment, unlike the former arrangement in which the distance between the source of liquid and the platform defines the height of the container to be filled so that the platform position needs to be changed for use with different containers.

In the embodiment with a cradle from which the container in use depends, the cradle is preferably pivoted about a substantially horizontal axis. This embodiment has the advantage of relative simplicity, with the empty container being mounted by simply pulling down the pivoting cradle, against the action of a spring force, slotting in the container and letting it go.

BRIEF DESCRIPTION OF THE DRAWINGS

Embodiments of the invention are described in detail below, by example only, with reference to the accompanying drawings, wherein.

DETAILED DESCRIPTION OF THE PREFERRED EMBODIMENTS

Figure 1:
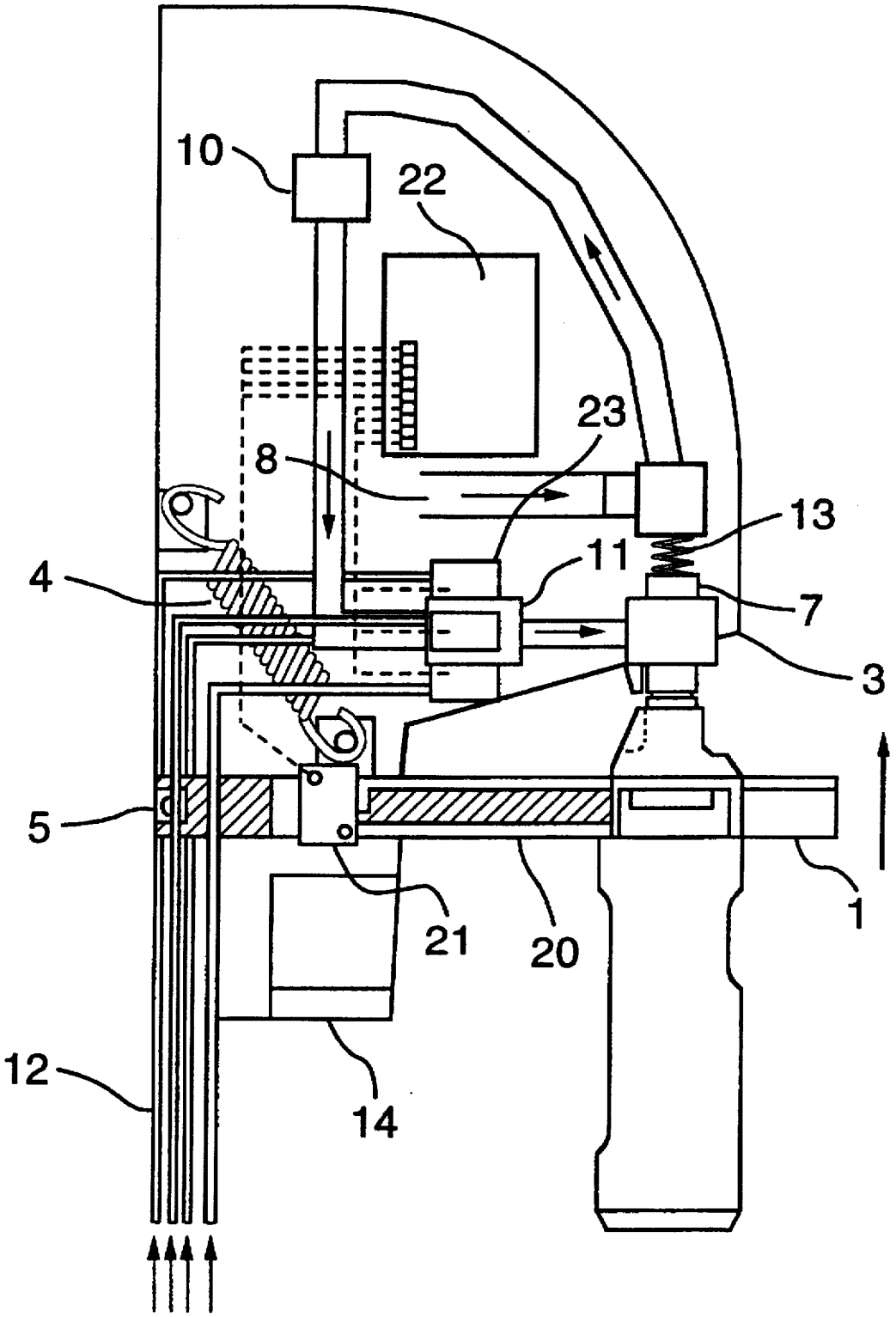
FIG. 1 is a schematic elevational view of a dispenser according to the invention.

The dispenser shown in FIG. 1 comprises a support 1 for a container 2 to be filled by liquid through a dispensing head 3. The support 1 carries the weight of the container with the assistance of the action of a spring 4. The support 1 is pivoted about horizontal axis 5.

In operation, the support or cradle 1 is lowered manually, against the action of the spring 4, and the container 2 is fitted on the support 1. The force of the spring 4 urges the neck of the container into the dispensing head 3. This action moves magnet 7 upwards.

The magnet 7, which replaces the usual coil, is mounted on a solenoid valve 9 and as it moves along the valve stem it causes the valve 9 to open. Water from a source (not shown) can therefore pass along pipe 8, through valve 9, through the backflow preventer 10 and to the venturi 11 where it entrains concentrated chemical fed through one of a number of pipes 12 (here four). The diluted liquid is then filled into the container 2 through the filling head 3. The particular operation of the valve 9 and the filling head 3 is not important in the present application. It is described in more detail in European Application no. 93302624.7 in the name of Diversey Corporation, (the subject matter of which is incorporated hereby by reference) but the skilled man will in any event see that there are many possibilities for filling the container.

With the increasing weight of the container as it fills, the cradle 1 and the container are lowered, thereby allowing the magnet 7, pushed by valve spring 13, to move back down the valve stem. This movement, at a predetermined point corresponding to the required weight of the filled container, closes the valve and stops the flow of water and chemical to the container. Overflowing of the container is thus automatically prevented.

The filled container is then manually released from the support 1, which is pulled back up by the spring 4 but in the absence of another container does not actuate the valve.

Indicated in a purely schematic manner in FIG. 1 are spring-loaded keys 20, switches 21, electronic controller 22 and a number of electronically operated valved product ports 23 at the venturi 11, each port 23 being fed by one of the product pipes 12. The operation of the keys, switches, controller and ports is described in more detail below, with reference to FIGS. 2 and 3.

Figure 2:
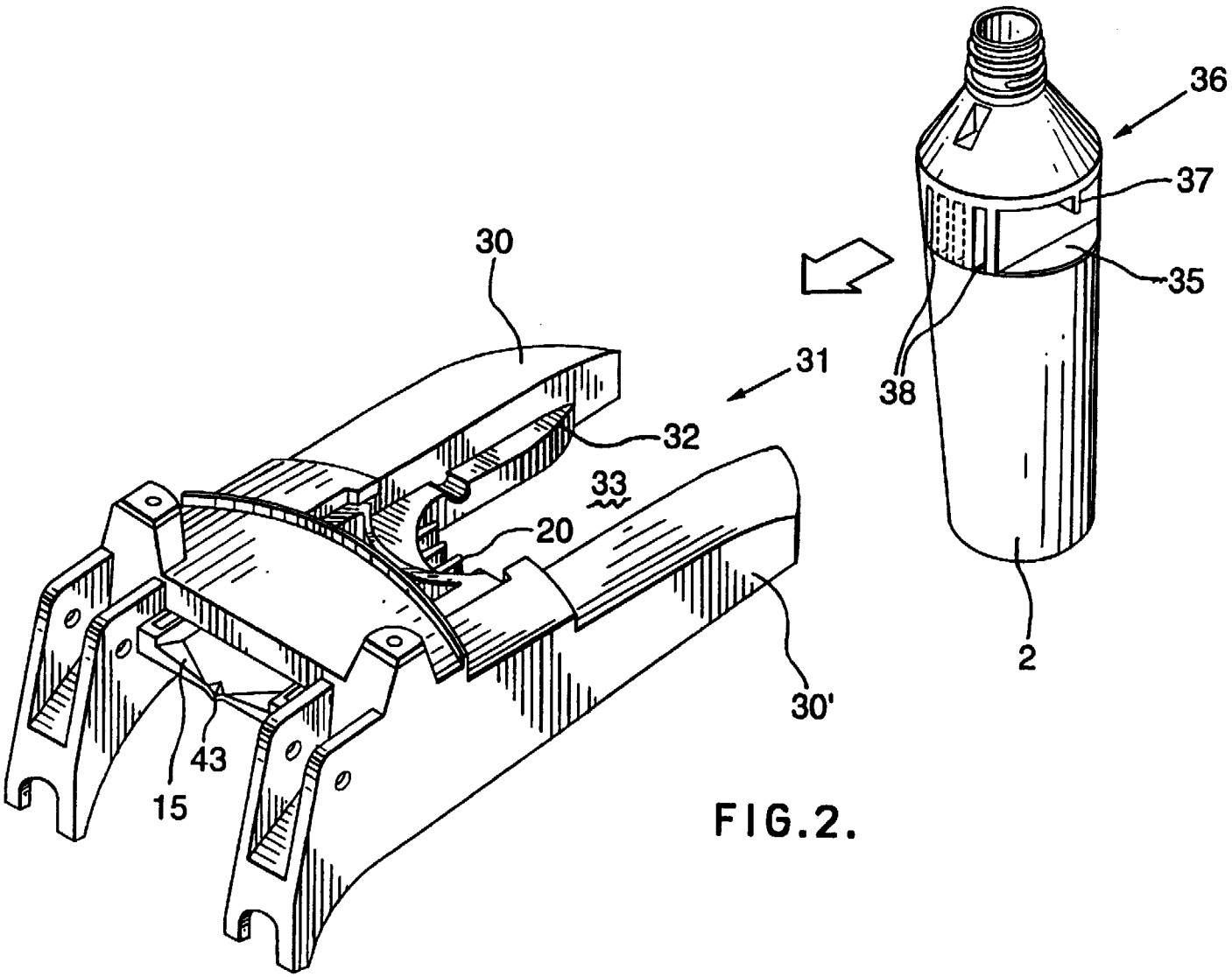
FIGS. 2 and 3 are detail views of FIG. 1 showing the operative connection between the dispenser and the container from above and below respectively.
Figure 3:
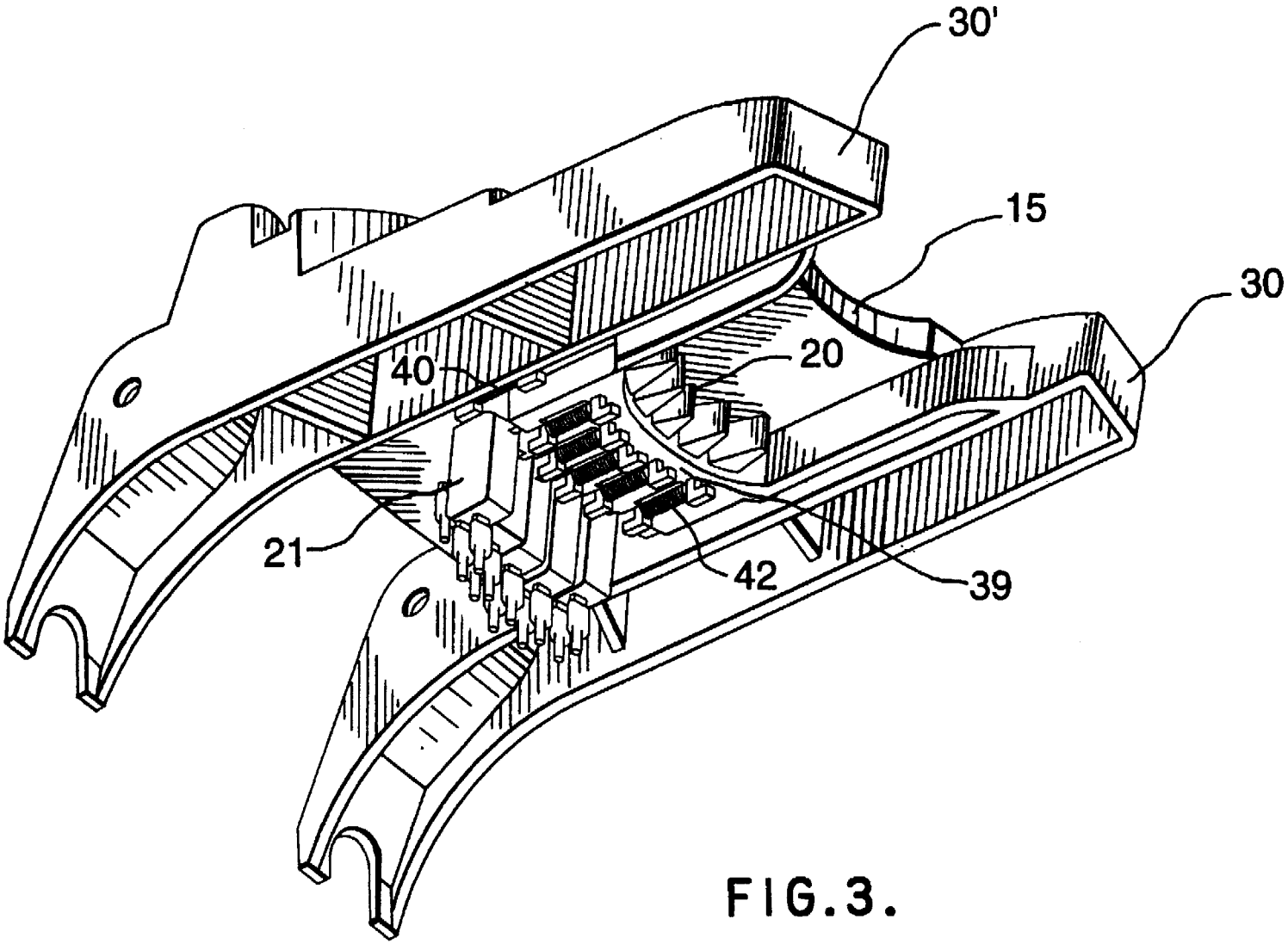

Also seen in FIG. 1 is a drip container 14 which collects drips from a drip tray, shown in FIGS. 2 and 3, which in the absence of a container adopts a position beneath the filling head 3.

Although in FIG. 1 the cradle 1 is shown to be pivotally mounted, this is not essential. The cradle could alternatively be fixed and the filling of the container could be controlled by suitable switches rather than by movement of the container into the filling head.

FIGS. 2 and 3 show schematically the operable connection between the container 2 and the cradle 1. FIG. 2 is a perspective view from above of the cradle removed from the dispenser, the container with a predetermined profile also being seen in this view. FIG. 3 is a perspective view of the cradle of FIG. 2, but from below.

The cradle is formed with a pair of forwardly extending arms 30, 30' with a slot 31 defined therebetween. On the inside of each arm is a shoulder 32, with a recess 33, at one point along its length. The recesses 33 are formed opposite each other, across the slot, and each has a generally U-shape which tapers outwardly towards the top.

Drip tray 15 is seen at the left hand side of FIG. 2. The drip tray is shown in a position retracted beyond the position to which it would be pushed by a container. Without the container present in the slot 31, the drip tray 15 would normally be pulled forward by a spring 40 (FIG. 3) to a position over the recesses 33, i.e. beneath filling head 3 in order to catch drips therefrom.

At the closed end of the slot 31 is a plurality of spring-loaded keys 20. In the illustrated embodiment there are five keys, each being urged forwardly by a spring 42 in FIG. 3.

The container 2 has segmental recesses 35 on either side, below shoulder 36 (only one recess is seen in FIG. 2). The narrowed portion formed by recesses 35 has a width just less than the gap between the shoulders 32, 32'. A lug 37 depends from the top of each recess 35. The lugs 37 are loosely fitted in the recesses 35 whereby the container drops slightly when the lugs engage the recesses. Such dropping action of the container signals to the operator that the container is in position and ready to receive liquid from the dispenser. By virtue of the loose fit of the lugs 37 in the recesses 35, the container may pivot relative to the cradle as it rises so that the container may always remain in the vertical orientation. A further benefit in the lugs 37 dropping into recesses 35 is to resist the spring force on the drip tray, moving the tray outwardly and hence pushing the bottle off the cradle.

In the side of the container, between the recesses, slots 38 are formed, in two of five possible positions (two alternative positions are shown in dashed lines; the fifth one is out of view).

The keys 20 are seen more clearly in the underside view of FIG. 3. The keys are in the form of fingers which are slidingly mounted in a web 39 which joins the shoulders 32 at the rear of the slot 31. The ends of the fingers 20 are rounded to facilitate their entry into the slots 38 of the container 2.

In order to ensure that the predetermined profile having a signature peculiar to the liquid to be dispensed is aligned with the keys, the recesses 35, by virtue of their interaction with shoulders 32, align the predetermined profile having slots 38 with the keys 20. Such alignment ensures that the first slot is aligned with the first key, the second slot aligned with the second key, etc. through to the fifth slot being aligned with the fifth key. Such alignment ensures that the correct corresponding keys are either depressed or not depressed whereby the desired liquid is dispensed into the container in accordance with the predetermined profile. Appropriate labelling can also be included on the bottle to ensure that the predetermined profile is directed into the cradle slot 31. This will ensure that, should the operator inadvertently insert the bottle with the predetermined profile directed away from the slot 31, the label will indicate incorrect direction of insertion, so that the operator can reverse bottle orientation by 180° and then proceed with dispensing of the desired liquid into the container.

Behind each key finger 20 is a micro-switch 21 which is actuated by the finger being pushed rearwardly. Electrical connections run from the micro-switches 21 to the electronic controller 22 and from the controller 22 to the valved ports 23 (see FIG. 1).

In use, the cradle 1 is lowered and the container 2 is slotted into the cradle 1, along the slot 31, thereby pushing back drip tray 15. Two of the fingers 20 register in the slots 38, the remaining three pins being pushed rearwardly, and the container 2 can then be allowed to hang on the cradle 1, with its lugs 37 fitting into the recesses 33, on the shoulders 32. When the container is released, the spring 4 swings the cradled bottle upwardly to actuate dispensing. As noted, the lugs 37 permit the bottle to pivot and thereby remain vertical. It should also be noted that the slots 38 extend vertically a sufficient distance to accommodate movement of the respective keys 20 in the slots as the container pivots slightly relative to the cradle.

The three fingers 20 which are pushed back by the container 2 actuate the respective switches 21 which in turn send electric signals to the electronic controller 22. The combination of signals is interpreted by the programmed controller 22 which then actuates the appropriate valve for port 23, preferably via a corresponding solenoid valve, for the corresponding liquid product to be dispensed into the container through the filling head 3.

It will be understood that different containers for different products will have a different arrangement of slots 38. With the slots in a different position, a different combination of switches will be actuated and the controller, in accordance with its preprogrammed logic, will interpret the different signals in order to fill the desired product. The arrangement of five key positions and five slot positions allows ten different discrete arrangements for different product containers, using two slots in the container (the use of only two slots is not, of course, essential).

It is also understood that the containers can be loaded with two or more liquids at the same time where the two or more liquids constitute reactants which react "in situ" in the container to form a desired cleaner or sanitizing agent. For example, as described in applicant's European patent 184, 904-B1, (the subject matter of which is incorporated by reference) an "in situ" preparation of an interhalogen disinfecting composition is prepared. For example, an iodide, iodate and chloride may be reacted in the presence of an acid to form the interhalogen $ICl_2$. The freshly prepared interhalogen may be then immediately removed from the container for purposes of sanitizing and disinfecting surfaces requiring manual treatment. A further example of such "in situ" preparation of an active ingredient is described in applicant's published European application 93302394.7, the subject matter of which is also incorporated by reference.

It is also understood that, in accordance with other various alternative embodiments for the dispensing head, the bulk containers for the various liquids to be dispensed may be diluted with water and under pressure or positioned for gravity feed so that when a container with a predetermined profile is inserted in the dispenser the one or more liquids are dispensed directly into the container without the need for the main water line 8 drawing the desired liquid through venturi 11.

Figure 4:
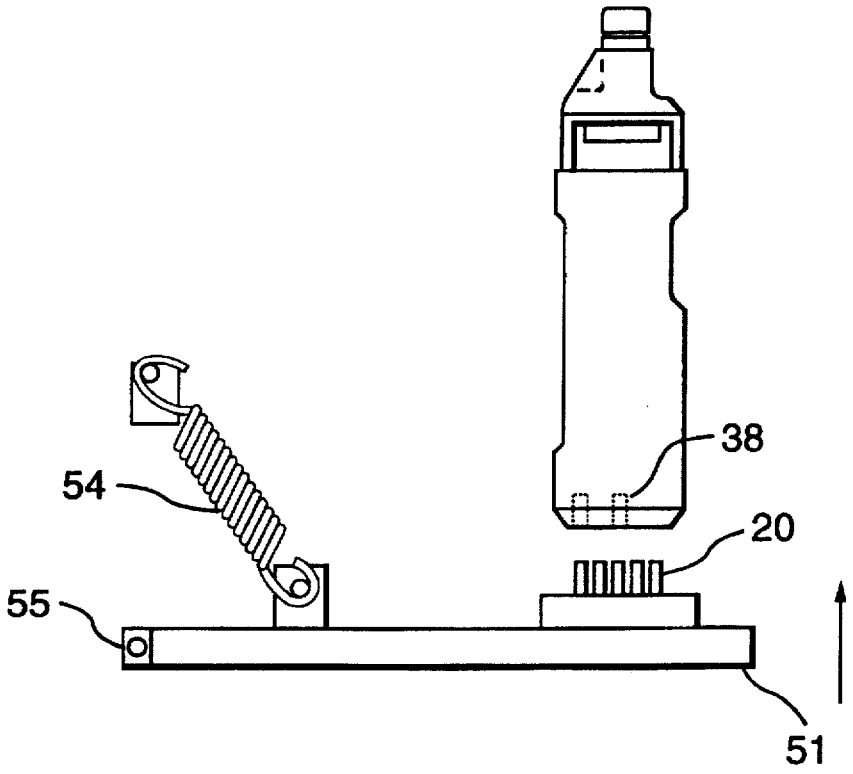
FIG. 4 is an elevation view of an alternative embodiment for the dispenser of this invention.

In the embodiment of FIG. 4, the cradle 1 of FIG. 1 is replaced by a platform 51 on which the container 2 can rest. The moveable keys 20 are provided in the platform and the base of the container has a number of slots 38 in a predetermined pattern. Switches 21 (not shown) are provided beneath the platform and the switches of the keys which do not register in the slots of the container are actuated in order to allow the correct liquid to be dispensed, in the same manner as described with reference to FIG. 1.

The platform may be pivoted and spring-mounted, in order to lift the container into the filing area as in FIG. 1, or it can be fixed and the valve 9 can be actuated by a suitable switch (possibly operated manually). FIG. 4 shows spring 54 which forces the platform 51 to pivot upwardly about hinge 55.

In the embodiment of FIG. 4, the keys 20 are moveable in a substantially vertical direction, with the container 2 being placed down onto the platform. If, however, the container was to be slid onto the platform, the keys could of course be moveable substantially horizontally, with the slots 38 being provided on the side of the container.

Figure 5:
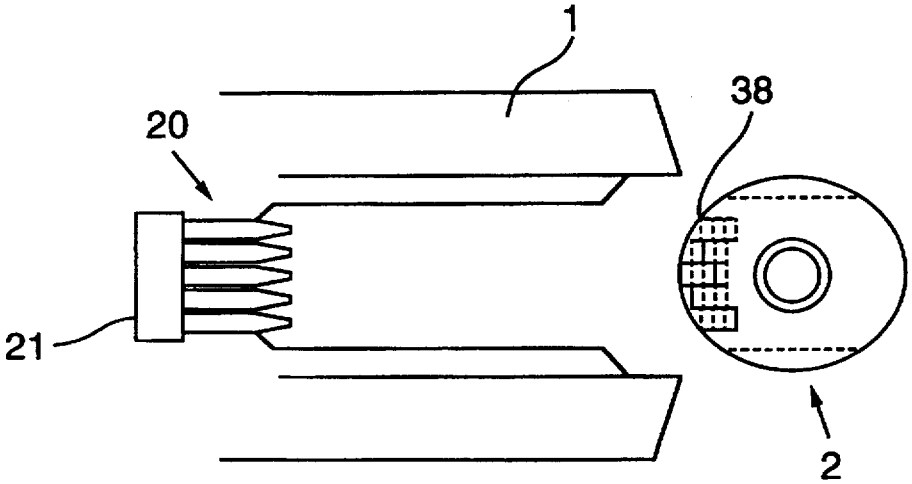
FIG. 5 is a top plan view of an alternative embodiment for the interaction of the container slots with the dispenser keys.

In the embodiments of FIGS. 1 and 3, the keys 20 may have two positions, depressed or not depressed. Thus, the micro-switches need have only two states, "on" or "off". This "binary" system is not, however, essential. In other words, the slots 38 could have a number of different depths to provide for a number of different key positions. This is schematically illustrated in FIG. 5 in which the different possible depths of sots 38 are shown in dashed lines. FIG. 5 shows in plan view a container slotting into cradle 1 of FIGS. 1 to 3.

Obviously, in the embodiment of FIG. 5, as in the other embodiments, the slots need not be discrete; they can if necessary be connected so as to provide a stepped profile in the container.

Figure 6:
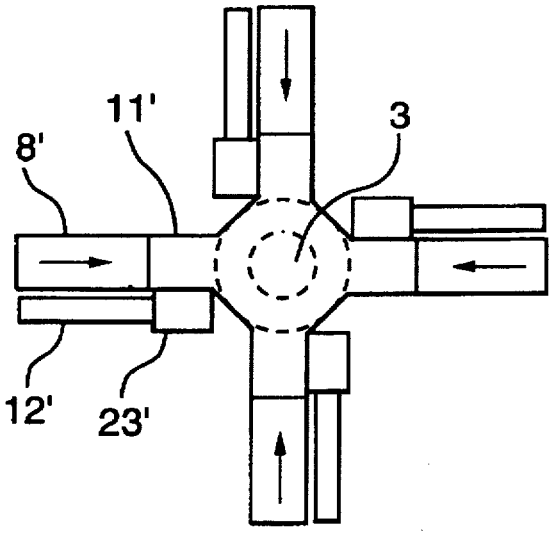
FIG. 6 is a top plan view of an alternative embodiment for the port valving and dispensing head for the dispenser of FIG. 1.

In FIG. 6, an alternative liquid filing system is schematically illustrated. Here the controller 22 controls separate solenoid valves in separate ports 23' connected to separate water lines 8'. When a respective valve is opened by the controller, on receiving appropriate signals from the switches, a venturi 11' entrains the correct chemical from pipe 12' into one of the water lines 8' and the diluted chemical is fed to the filling head 3 around which the ports 23' are mounted.

Figure 7:
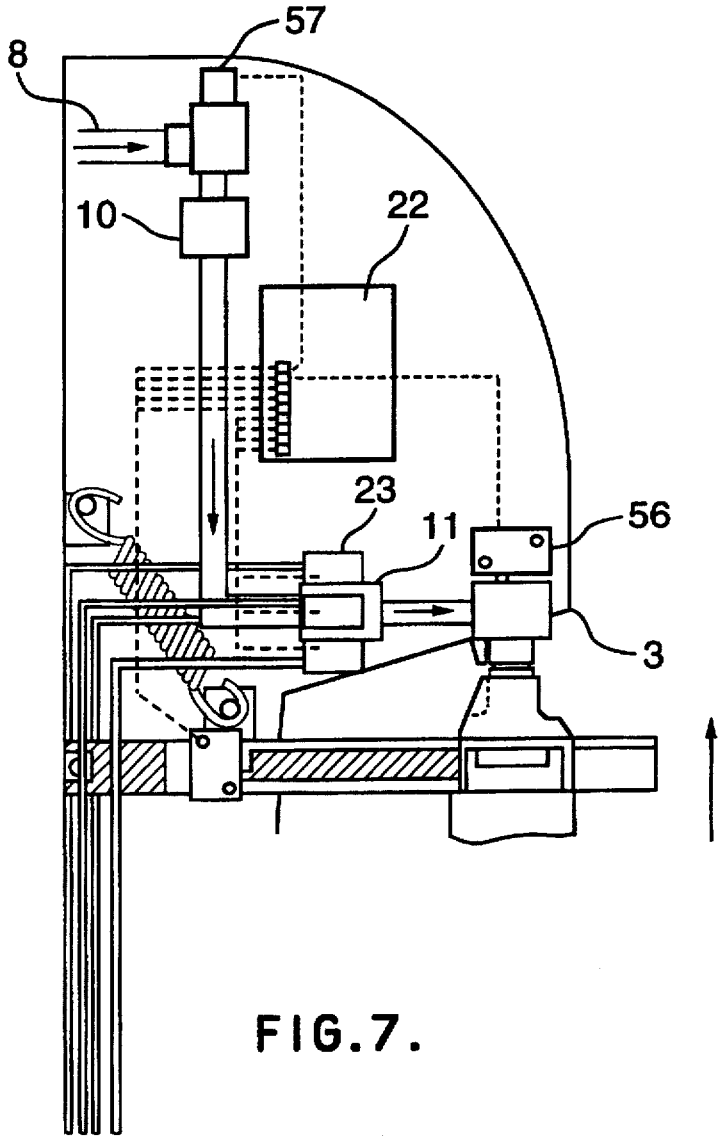
FIG. 7 is a schematic elevational view of an alternative embodiment for the water flow control system.

In FIG. 7, an alternative system for controlling the water flow is illustrated. Instead of the moveable magnet 7 of FIG. 1, movement of the container actuates a micro-switch 56 which then opens solenoid valve 57, the control signal from switch 56 going through controller 22. Apart from this difference, the embodiment of FIG. 7 is the same as FIG. 1.

In summary, the dispenser, in accordance with this invention, provides a system which is reliable, rugged and facilitates several reuses of the container to thereby minimize container scrap. The system is rugged in that the keys 20 are protected by any corrosive chemicals which may drip from the dispenser head. The drip tray 15, in its extended position, is shown in FIG. 3 where the drip tray covers the keys 20, their springs 42 and the switches 21. The drip tray 15 is designed to have a trough 43 located at the rear of the tray, such that any drips that fall onto the tray drain from trough 43 into drip container 14. Hence the keys 20 are always maintained in a clean extended position. It is appreciated, of course, that from time to time the springs 42 may require a lubricant to ensure that none of the keys 20 remain in a depressed position when a container is removed from the cradle or from the platform. The predetermined signature profile on the container in the form of recesses provides a very durable rugged form of bottle signature, so that the bottle may be reused several times over without loosing its distinctive code. When the bottle is reused, one can be assured that the slots by virtue of the alignment means in the form of the recesses 35 interacting with the ledges 32 align the slots with the respective keys so that there is consistent reliable and accurate actuation of the one or more valves to dispense the correct corresponding one or more liquids into the container. By virtue of the predetermined profile of the container being moved towards the keys, where each key is either individually depressed or remains extended depending upon whether the key is aligned with a projecting surface of the profile or a slot of the profile, ensures that inadvertent actuation of the one or more of the switches is avoided. In systems where the keys are sequentially depressed and then allowed to pop out, as a card is inserted into a reader, can result in one or more of the keys remaining depressed and providing a false reading. The physical sensing, in accordance with this invention, of bottle signature, that is the predetermined profile, ensures over extended bottle reuse, that correct filling of the bottle is always achieved. Furthermore, in view of the programmable nature of the bottle dispensing system, a single dispenser head can now service a variety of bottles with a corresponding variety of liquids.

Although preferred embodiments of the invention are described herein in detail, it will be understood by those skilled in the art that variations may be made thereto without departing from the spirit of the invention or the scope of the appended claims.

I claim:

1. A dispenser for dispensing a liquid into a container of a predetermined profile, said dispenser comprising:

a support for the container;

a plurality of sources of different liquids;

valve means regulating the flow of liquid from the sources into the container;

a series of keys on the support, each key being moveable between at least two positions;

switch means actuated by the respective keys; and control means connected between the switch means and the valve means, whereby on mounting a particular container on the support, the keys are moved in a predetermined way by a container profile and the control means in response to at least one key being moved, actuates the valve means to dispense liquid from said plurality of sources into the container.

2. A dispenser according to claim 1, wherein the keys are arranged in a substantially horizontal row.

3. A dispenser according to claim 2, wherein the keys are mounted in a cradle from which the container can be suspended.

4. A dispenser according to claim 3, wherein a retractable drip pan is positioned over said keys when said cradle is free of a container.

5. A dispenser according to claim 2, wherein each key has a respective switch associated therewith and wherein each respective switch has a plurality of positions.

6. A dispenser according to claim 5, wherein each key has two positions, a first normally extended position and a second normally retracted position.

7. A dispenser according to claim 1, wherein the keys are provided in a platform on which the container can stand.

8. A dispenser according to claim 7, wherein the keys are moveable substantially vertically.

9. A dispenser according to claim 1, wherein said valve means comprises a separate valve for each liquid of said plurality of sources, said control means actuating at least one valve in response to at least one key being moved.

10. A dispenser according to claim 1, wherein said control means actuates one valve in response to two or more keys being moved.

11. In combination a dispenser of any one of the preceding claims in combination with a container of a predetermined profile, the predetermined profile of said container being its signature for the type of liquid to be dispensed into said container, the predetermined profile of the container being provided on the container so as to be aligned with the series of keys when the container is in filling position on the support.

12. The combination in accordance with claim 11 wherein said predetermined profile comprises a plurality of adjacent projections and/or recesses on a container, the projection moving the corresponding key whereas the recess in avoiding contact with the corresponding key, not moving the key.

13. The combination in accordance with claim 11, wherein said support and said container comprises co-acting guide means, said guide means aligning said predetermined profile with said series of keys to ensure movement of the correct one or more keys by said predetermined profile.

14. The combination in accordance with claim 13 where said co-acting guide includes interacting lugs and recesses whereby said container drops into the support to indicate that the container is in position to receive liquid from said dispenser.

* * * * *